United States Patent [19]

Goldman

[11] Patent Number: 4,790,599

[45] Date of Patent: Dec. 13, 1988

[54] PIVOTING RECLINER APPARATUS AND METHOD

[75] Inventor: Paul R. Goldman, 8 Joyce Ter., Andover, Mass. 01810

[73] Assignee: Paul R. Goldman, Andover, Mass.

[21] Appl. No.: 93,150

[22] Filed: Sep. 2, 1987

Related U.S. Application Data

[63] Continuation of Ser. No. 853,005, Apr. 17, 1986, abandoned.

[51] Int. Cl.[4] ..... A47C 1/02

[52] U.S. Cl. ..... 297/327; 297/68; 297/282

[58] Field of Search ..... 297/326, 327, 281, 282, 297/276, 258, 313, 271, 68

[56] References Cited

U.S. PATENT DOCUMENTS

| | | | |
|---|---|---|---|
| 93,660 | 8/1869 | Theaker | 297/327 X |
| 825,984 | 7/1906 | Schmersahl | 297/282 X |
| 3,235,304 | 2/1966 | Glass | 297/282 X |
| 4,092,041 | 5/1978 | Landry et al. | 297/271 X |

FOREIGN PATENT DOCUMENTS

| | | | |
|---|---|---|---|
| 526911 | 3/1954 | Belgium | 297/328 |

*Primary Examiner*—James T. McCall
*Attorney, Agent, or Firm*—Hale and Dorr

[57] ABSTRACT

A reclining structure has a supporting frame structure and a fixed seat structure. The fixed seat structure is allowed to swing or pivot about a raised pivot connecting point on the frame structure so that, in its most reclined position, an occupant of the recliner has his feet raised to a level above his heart. The recliner seat structure features a back section, a seat section, and a footrest section, the three sections having a fixed structural relationship to each other. The frame structure features a first and a second side member, and elements for pivotably connecting the seat structure to the side members for swinging motion therebetween. The side members support, from the pivot point in each side member, the weight of the seat structure. The side members also support, in this manner, the weight of any occupant of the recliner. Thereby, the seat structure can swing beneath a pivot axis defined by the pivot points of the first and second side members.

4 Claims, 4 Drawing Sheets

PIVOTING RECLINER APPARATUS AND METHOD

This is a continuation of application Ser. No. 853,005, filed Apr. 17, 1986 now abandoned.

BACKGROUND OF THE INVENTION

The invention related generally to furniture and in particular to a new recliner apparatus and method for raising the feet of an individual occupying a recliner above the level of his heart.

Chairs, and recliners in particular, have been manufactured by the furniture industry for hundreds of years. In its simplest form, the rocking chair acts in part as a recliner and allows its occupant to "lean back" in a substantially stable condition, or to rock back and forth, around a moving pivot point close to the floor.

There also exists many other recliners such as those which allow one to adjustably recline and, at the same time, many of them provide a footrest which pivots upward as the recliner back moves down, leaving the occupant in a substantially supine position. All of these recliners, are intended to allow the individual to relax and have not changed their basic structure and operational environment even though technology, and in particular medical technology, has made great advances over the past few decades.

Objects of the present invention are a recliner apparatus and method in which the occupant assumes, in the reclined state, a more optimum position for achieving relaxation, which is simple to manufacture, which is of reliable construction, and which is comfortable to the occupant.

SUMMARY OF THE INVENTION

A reclining structure according to the invention has a supporting frame structure and a fixed seat structure. In accordance with the invention, the fixed seat structure is allowed to swing or pivot about a raised pivot connecting point on the frame structure so that, in its most reclined position, an occupant of the recliner has his feet raised to a level above his heart.

The recliner seat structure features a back section, a seat section, and a footrest section, the three sections having a fixed structural relationship to each other. The frame structure features a first and a second side member and elements for pivotably connecting the seat structure to the side members for swinging motion therebetween. The side members support, from the pivot point in each side member, the weight of the seat structure. The side members also support in this same manner the weight of any occupant of the recliner. Thereby, the seat structure can swing beneath a pivot axis defined by the pivot points of the first and second side members, and the fixed structural relationship of the seat structure provides, in the fully reclined position, that the feet of the occupant of the recliner are above the occupant's heart.

BRIEF DESCRIPTION OF THE DRAWINGS

Other objects, features, and advantages of the invention will appear from the following description of a preferred embodiment, taken together with the drawings in which.

DESCRIPTION OF A PREFERRED EMBODIMENT

Figure 1:
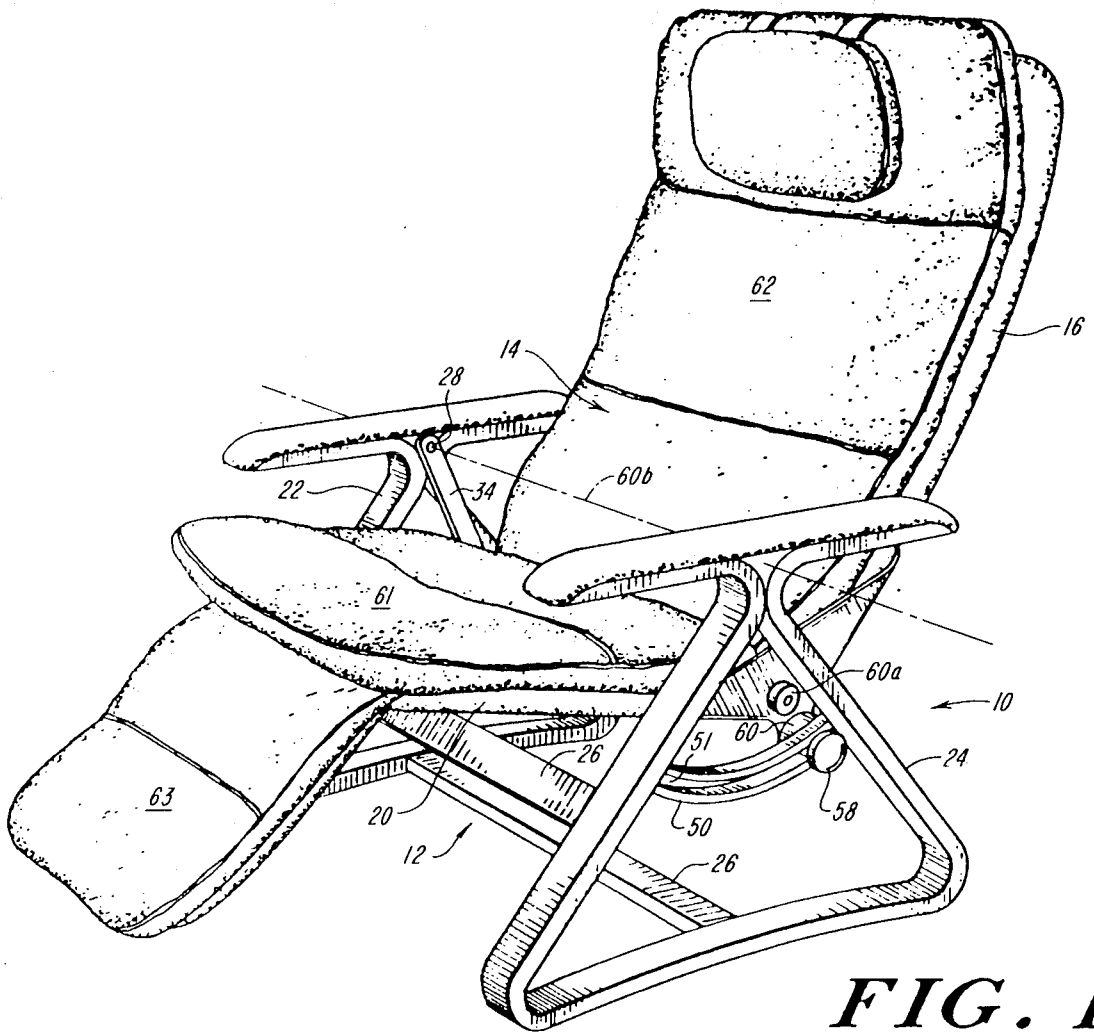
FIG. 1 is a perspective view of a recliner according to the invention.
Figure 2:
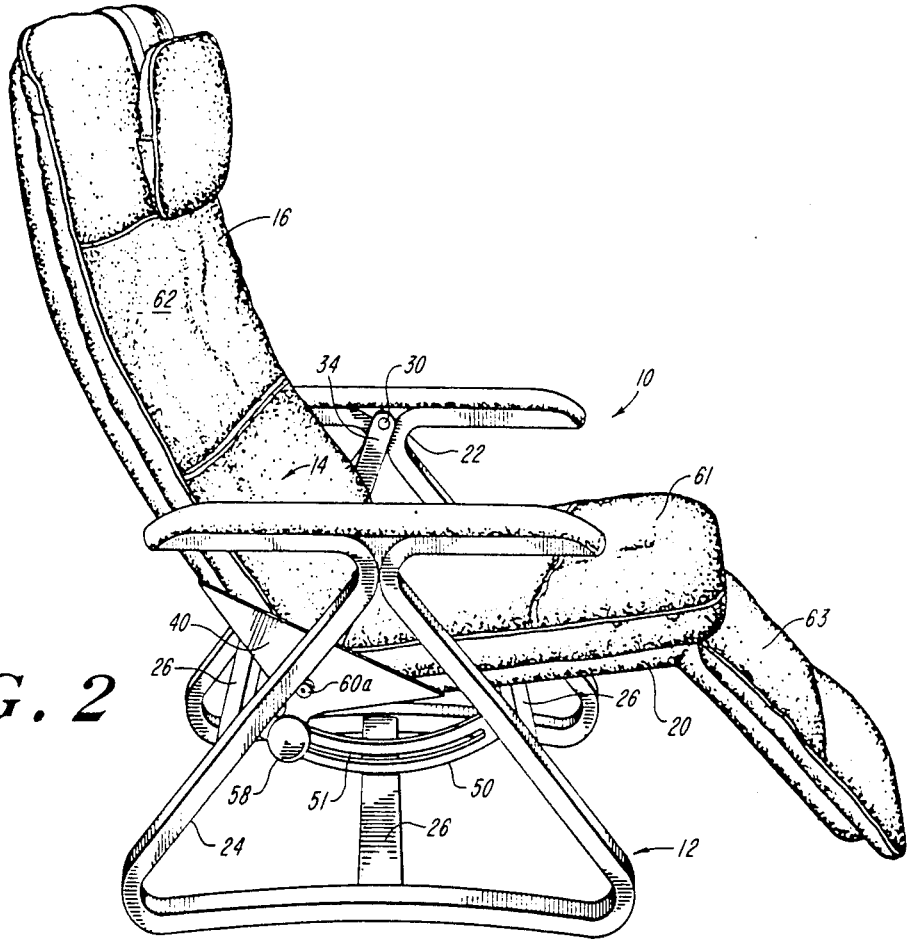
FIG. 2 is a side view of the recliner of FIG. 1 in its uppermost position.

Referring to FIGS. 1–4, a recliner 10 has a support frame 12 from which pivots a body section 14. The body section has a back portion 16, a seat and a leg rest portion 20. The frame 12 has side supports 22 and 24 connected by cross supports 26. Frame 12 supports, at pivot points 28 and 30 of side supports 22 and 24 respectively, through a frame supporting structure 32, the body section 14.

Figure 5:
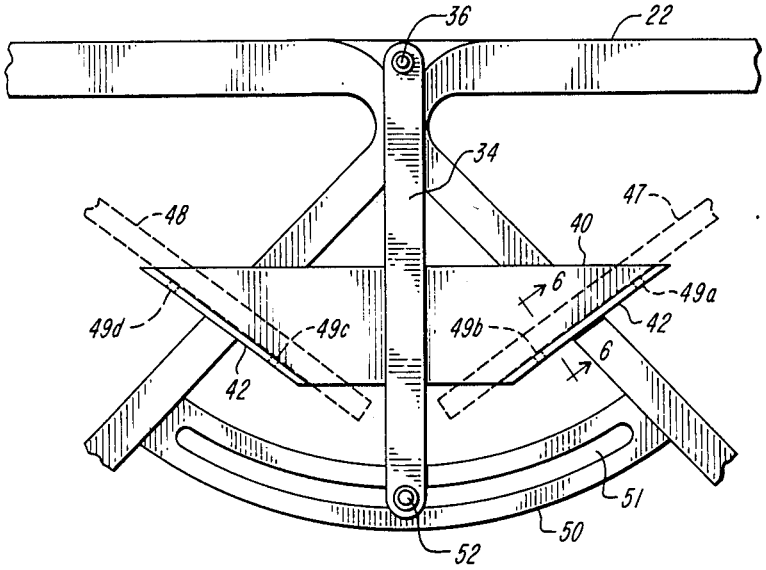
FIG. 5 is a partial side view of the frame of the recliner of FIG. 1 wherein the construction details of the recliner can be more clearly understood.
Figure 6:
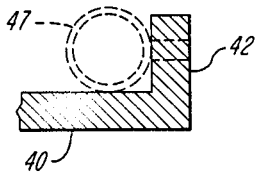
FIG. 6 is a cross-sectional view along lines 6—6 of FIG. 5.

Referring to FIGS. 1 and 5, the frame supporting structure 32 has bar members 34 extending from a pivot pin 36 on each side support 22, 24 and connecting to a substantially trapezoidally-shaped support plate 40. In the illustrated embodiment, bar members 34 are welded to the respective support plate 40. The trapezoidally-shaped plates 40, preferably constructed of heavy gauge plate steel, for example eleven gauge, support the tubular frames which define the back, seat, and footrest sections of the recliner body section 14. Each plate 40 has a bent up or flanged lip 42 (see FIG. 6) to support the tubular body frame pieces. The flanges 42 of each plate 40 extend inwardly of the chair and the tubular frame members 47, 48, shown in dotted outline, attach by bolts through holes 49*a*, 49*b*, 49*c*, 49*d* in the flange. The frame members are thus cantilevered from the pivoting support plate 40. The contoured back frame portion 16 and the seat and leg rest frame portion 20 are thereby positionally fixed in relation to each other.

Figure 3:
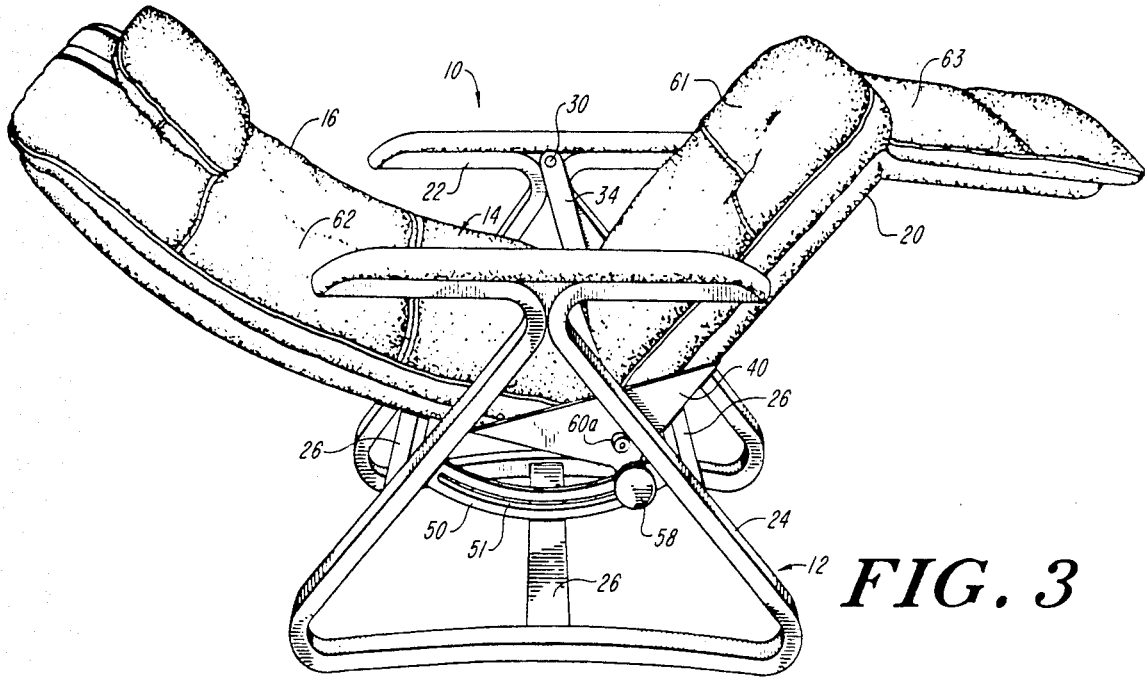
FIG. 3 is a side view of the recliner of FIG. 1 in a fully reclined position.
Figure 4:
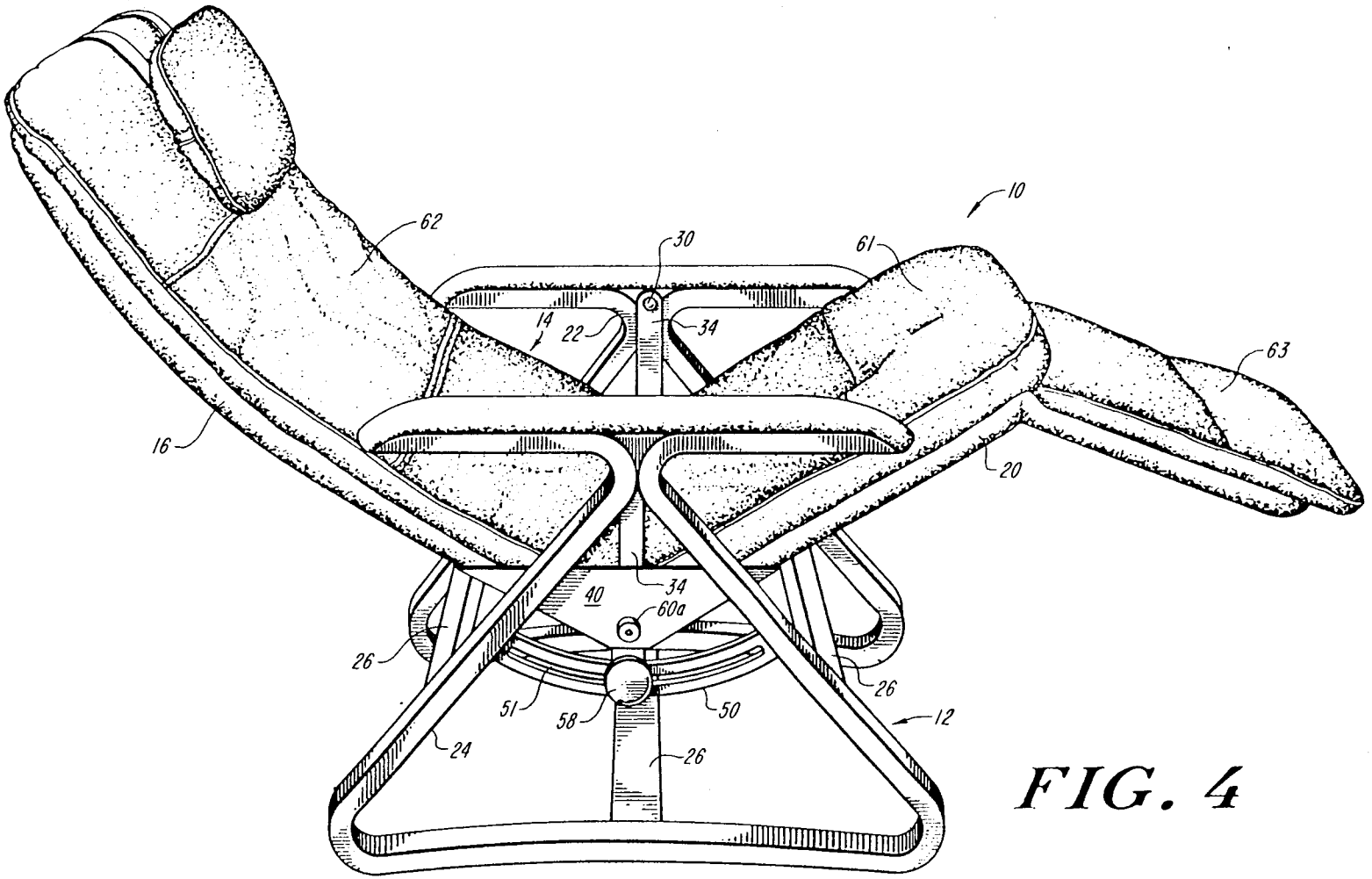
FIG. 4 is a side view of the recliner of FIG. 1 in a half-reclined position.

To provide additional stability to the structure, the bar members 34 extend past the trapezoidally-shaped members 40 and connect to a curved guide member 50 attached to and supported by each frame side member 22, 24. Each curved guide member is slotted at 51. A rod member or bolt 52 passes through bar 34 and engages a threaded terminating knob element 58. Spacer elements 60 provide the correct distancing between the bar 34 and guide member 50; and in the illustrated embodiment, leather washers separate both the knob 58 and spacers from the guide member. There results an advantageous sliding relationship along the slot direction while providing connecting support for the bar 34. Accordingly, therefore, an individual seats himself into the chair in the FIG. 1 or FIG. 2 position and can lean backward to recline the chair as shown in FIG. 3. If a partial inclination, such as is illustrated in FIG. 4, is desired, knobs 58 can be tightened to hold the body section 14 at a selected position.

Referring to FIG. 3, in the fully reclined position, the occupant of the chair assumes a supine position wherein the feet are elevated above the position of the heart. It is considered that this posture provides advantageous relaxation conditions for the body.

The swinging motion of the recliner, as it pivots about pivot points 28 and 30, provide a simple and reliable structure. A cushioned bumper element 60*a*, secured to plates 40 on each side of the chair, limits the extent of angular rotation of the body section around a pivot axis 60*b* defined between the pivot points 28, 30.

In addition, in accordance with the preferred embodiment of the invention, full support of the occupant of the chair is provided by covering the tubular frame supporting structure of the back, seat, and footrest with a canvas material, laced at an open end of each section, (and preferably in the space between the bars 34), and placing between the occupant and the canvas material, the cushioned seat, back and foot sections illustrated at 61, 62, and 63, respectively. The cushioned sections can be attached to the canvas using, for example, Velcro fasteners.

Additions, subtractions, deletions, and other modifications of the described embodiment of the invention will be apparent to those skilled in the art and are within the scope of the following claims.

What is claimed is:

1. A swinging recliner structure comprising a supporting frame structure, and a fixed seat structure, said seat structure having a back portion, a seat portion, and a footrest portion, said back, seat, and footrest portions having a fixed, integral, positional relationship to each other, said frame structure having a first and a second side member, means for pivotably connecting said seat structure to said side members for freely swinging motion therebetween between an upright sitting position and a maximum fully reclined position, said side members supporting, from a pivot pin in each side member, the weight of the seat structure including the weight of any occupant of the seat structure, bar members extending downward from a pivoting connection of said bar members with said side members at the pivot points, and connecting to said seat structure for supporting said seat member, and a guide track element supported by each side member for connecting to said bar members for providing stability to said recliner structure, whereby said seat structure can swing beneath a pivot axis defined by the pivot points of the first and second side members, said fixed positional relationship provides, in fully reclined position of said seat structure, that the lower legs, below the knee, of an occupant of the recliner are above the occupant's heart, and means for positionally fixing said seat structure at least in said upright sitting position and said fully reclined position.

2. The recliner of claim 1 further comprising seat positioning means for fixing the reclining position of said seat structure relative to the frame structure at a continuum of positions between said upright position and said fully reclined position.

3. The recliner of claim 1 further wherein said guide track element has a slot for allowing connection to said bar member and for allowing pivoting movement of said seat portion to a fully reclined position wherein an individual occupying the recliner has his lower legs, below the knee, at a height greater than the location of his heart.

4. The recliner of claim 3 further comprising a delimiting, cushioned bumper connected to said frame structure for limiting the swinging movement of said seat structure.

* * * * *